United States Patent [19]

Okada

[11] 4,084,782

[45] Apr. 18, 1978

[54] SPLIT MOULD FOR MAKING TAPERED CONCRETE POLES

[75] Inventor: Senri Okada, Tokyo, Japan

[73] Assignee: Nippon Concrete Kogyo Kabushiki Kaisha, Tokyo, Japan

[21] Appl. No.: 754,741

[22] Filed: Dec. 27, 1976

[51] Int. Cl.[2] ..... B28B 21/82

[52] U.S. Cl. ..... 249/135; 164/292; 249/137; 249/173; 425/435; 425/DIG. 5

[58] Field of Search ..... 425/435, 440, 441, DIG. 5, 425/DIG. 129; 249/137, 164, 173, 135; 164/292, 293

[56] References Cited

U.S. PATENT DOCUMENTS

| | | | |
|---|---|---|---|
| 1,485,860 | 3/1924 | Ladd | 164/293 |
| 1,532,537 | 4/1925 | Ladd | 164/292 |
| 2,794,231 | 6/1957 | Lloyd | 425/435 |
| 3,110,074 | 11/1963 | Menzel et al. | 249/151 |
| 3,989,221 | 11/1976 | Okada et al. | 425/435 |

*Primary Examiner*—Francis S. Husar
*Assistant Examiner*—John McQuade
*Attorney, Agent, or Firm*—Oldham, Oldham, Hudak & Weber

[57] ABSTRACT

A tapered mould consisting essentially of a rigid outer frame formed of a set of radially arranged longitudinally extending guide members and a set of axially spaced encircling rings, and a gapped frustoconical tubular casing of resilient sheet material having a set of longitudinal stiffening members arranged thereon for sliding engagement with the respective guide members. The gap in the wall of the tubular casing, extending along a longitudinal line on the periphery of the casing, is opened and closed automatically as the tubular casing inserted in the outer frame is moved axially in opposite directions. Labor - consuming bolt - clamping and releasing operation is completely eliminated and the mould operation can be mechanized with ease, as desired. Packing means interposed between a pair of stiffening members arranged on the opposite sides of the gap further ensures leak - proof gap closing. Any accidental gap opening during casting operation can be prevented by arranging wedge means between one of the encircling rings on the outer frame and the two stiffening members.

4 Claims, 7 Drawing Figures

SPLIT MOULD FOR MAKING TAPERED CONCRETE POLES

BACKGROUND OF THE INVENTION

This invention relates to mould structures for use in making tapered electric poles or the like concrete products.

Previously known moulds of the kind described have generally been a cylindrical or frustoconical mould internally tapered at the same angle as piles to be formed and of the type axially split into two half mould sections. In use of such conventional moulds, it has been necessary to clamp the mould sections against each other along the longitudinal edges thereof by use of a large number of clamping bolts and nuts in order to hold the mould in a cylindrical or frustoconical formation and, in the assembling of the mould and the removal of the formed product therefrom, a considerable amount of manual labor has been required for bolt-clamping and releasing operation. On the other hand, for mechanization of such bolting operation, equipment is required which is of considerably complicated structure because of the radial bulk of drive wheels normally mounted around the periphery of the mould and thus imposes substantial restrictions upon other operations involved.

SUMMARY OF THE INVENTION

The present invention is designed to overcome the difficulties previously encountered as described above and has for its object the provision of a mould structure for use in making tapered concrete poles which is of a gererally tapered form, not including any clamping bolt means, and controllable to open and close, utilizing the taper of the mould itself.

Another object of the present invention is to provide a mold structure of the character described which can be operated in an efficient manner without necessitating any substantial manual labor for mould opening and closing operation and for removal of products and is particularly easy to mechanize such operations.

The above and other objects and advantages of the present invention will become apparent from the following description when taken in conjunction with the accompanying drawings.

BRIEF DESCRIPTION OF THE DRAWINGS

In the drawings, which illustrate one preferred embodiment of the present invention.

DESCRIPTION OF THE PREFERRED EMBODIMENT

Figure 1:
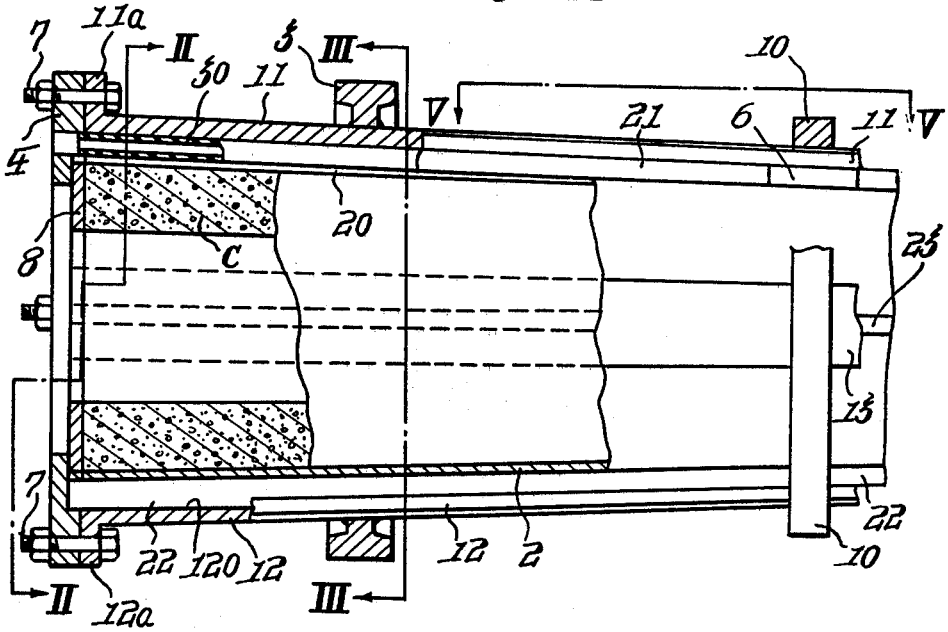
FIGS. 1 and 1A represent fragmentary side elevational views of the mould embodying the present invention, respectively illustrating the opposite end portions thereof, partly in axial cross section, along the line I—I in FIGS. 2 and 3 and the line IA—IA in FIG. 4, respectively.
Figure 1A:
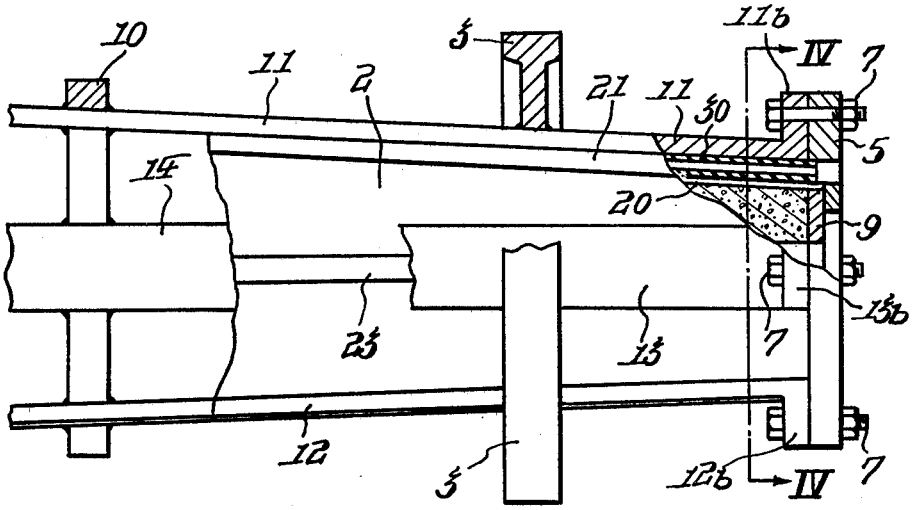
Figure 2:
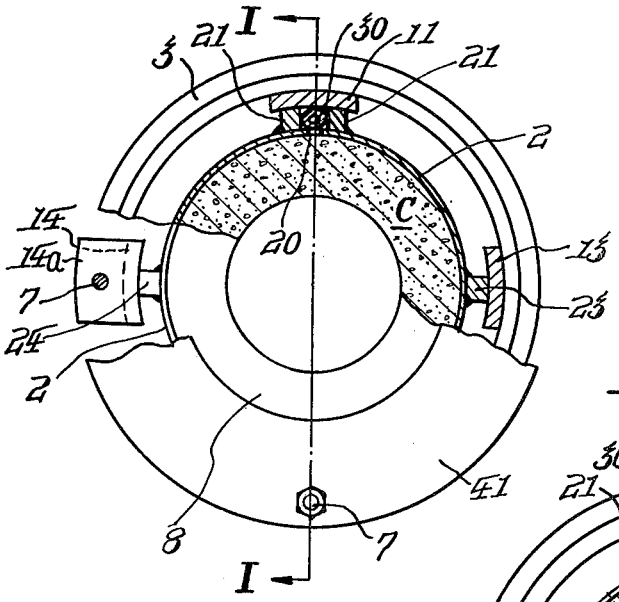
FIG. 2 is a cross-sectional view of same taken along the line II—II in FIG. 1.
Figure 3:
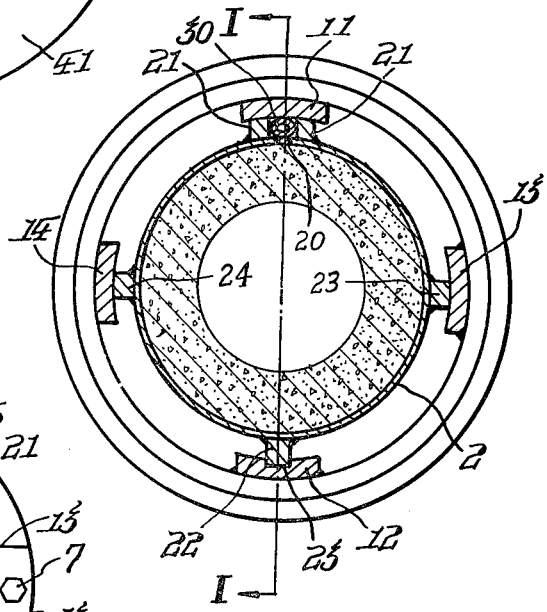
FIG. 3 is a cross-sectional view taken along the line III—III in FIG. 1.
Figure 4:
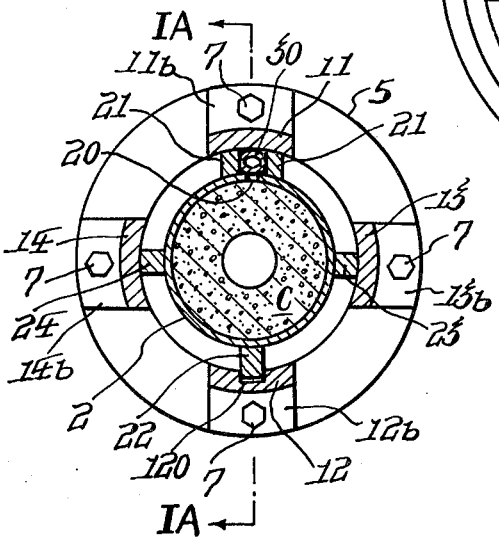
FIG. 4 is a cross-sectional view taken along the line IV—IV in FIG. 1A.

Referring first to FIGS. 1 and 1A, reference numerals 11, 12, 13 and 14 indicate a plurality, for example, four, to longitudinal guide members of substantially rectangular cross section which are radially arranged at 90° intervals about a common axis, as shown in FIGS. 2, 3 and 4, and each extend at a definite angle of inclination to the axis which corresponds to the taper angle of poles to be formed. A plurality of annular connecting members 10, having respective inner diameters reduced in succession, are secured as by welding to the four guide members 11–14 in encircling relation thereto at appropriate intervals along the length thereof. The sets of guide and connecting members, 1 and 10, together form a generally tapered outer frame of the mould illustrated which has an inner diameter defined by the radially inwardly facing sides of the four guide members 1 (11–14) and decreasing gradually along the axis of the frame, for example, from the left to the right end thereof, as illustrated.

Reference numeral 3 indicates an appropriate number of annular drive wheels secured by welding to the guide members 11–14 in encircling relation thereto at axially spaced locations and having one and the same outer diameter. As with the case of conventional forms of mould for centrifugal casting, the drive wheels 3 are placed in frictional engagement with drive rollers, not shown, which are driven by motor means, to serve the purpose of turning the outer frame about the axis thereof.

Reference numeral 2 indicates a tapered or frustoconical tubular casing made resilient, for example, of a thin steel sheet material and intended to serve as a form in which concrete is cast to the specified taper and outer diameter. The tapered tubular casing 2 has a gap 20 formed in its wall and extending along a longitudinal line on the periphery of the casing. It is to be noted that the gap 20 remains open under the resiliency of the casing itself as long as the latter is in a free state. A number of longitudinal stiffening members 21–24, of one and the same substantially square cross section throughout the length thereof, are secured integrally to the outer peripheral surface of the tubular casing 2 at 90° intervals. Specifically, two of the stiffening members, 21—21, are arranged along the gap 20 formed in the casing wall on the opposite longitudinal edges thereof, and another of the stiffening members, 22, is arranged on the casing wall at its bottom, as viewed in FIGS. 1 to 4. The remaining two stiffening members 23 and 24 are arranged diametrally opposite to each other on the right and left sides of the casing 2. As illustrated, these stiffening members 21–24 have their radially outer surfaces placed in sliding contact with the respective radially inwardly facing surfaces of the guide members 11–14 of the outer frame. Among others, the stiffening member 22, arranged diametrally opposite to the gap 20, is slidably fitted in a groove 120 of rectangular cross section formed in the radially inwardly facing surface of the adjacent guide member 12 longitudinally thereof and in this manner the tubular casing 2 in effectively prevented from angular displacement about the mould axis relative to the outer frame.

Reference numeral 30 indicates a tubular packing of rubber or synthetic resin material fitted between the paired stiffening members 21—21 for pressure contact with the adjacent guide member 11 and the gapped region of tubular casing 2. As will be readily understood, in use of the mould, when the gapped tubular casing 2 is radially compressed against its resiliency to close the gap 20, the tubular packing 30 is pressed, among others, against the gapped region of tubular casing 2 into sealing engagement therewith to serve the purpose of preventing the moisture content of raw concrete as placed within the tubular casing 2 from leaking radially outwardly through the gap 20.

In use of the mould, the resilient form or tubular casing 2 is pushed axially into the outer, rigid frame, comprised by four guide members 11–14, through the larger-diameter end toward the smaller-diameter end of the outer frame, for example, in a rightward direction, as viewed in FIGS. 1 and 1A and the stiffening members 21–24, arranged on the tubular casing 2 and placed in sliding engagement with the respective guide members 11–14 of the outer frame, are forced evenly radially inward against the resiliency of the tubular casing 2 itself until the gap 20 formed in the casing wall is closed completely.

Referring to FIGS. 1 and 2, reference numeral 4 indicates an annular end frame provided at the larger-diameter end of the mould to fix the adjacent ends of the four guide members 11–14 and tubular casing 2 relative to each other. The end frame 4 is stepped on the inside surface thereof at 90° intervals to receive the respective adjacent ends of stiffening members 21–24 and adapted to support an annular end plate 8, which is fitted to the adjacent end of the tubular casing 2 coaxially therewith. The end frame 4 is clamped by bolt means 7 against radially outwardly extending flanges formed on the respective adjacent ends of guide members 11–14, as indicated in FIG. 1 at 11*a* and 12*a* and in FIG. 2 at 14*a*. As with the case of conventional forms of mould of this kind, a braided structure of steel bars to be placed in the product concrete pole is inserted into the tubular casing 2 through the larger-diameter end thereof and concrete is poured through the central opening of annular end plate 8.

Referring to FIG. 1A, reference numeral 5 indicates an annular end frame, basically of the same formation as the end frame 4, provided to fix the guide members 11–14 and the tubular casing 2 relative to each other at the other, smaller-diameter end of the mould and stepped on the inside surface to receive the adjacent ends of respective stiffening members 21–24. Clamped to this end frame 5 by bolt means 7 are radially outwardly extending flanges 11*b*–14*b* formed on the respective adjacent ends of guide members 11–14, as clearly seen in FIG. 4. Reference numeral 9 indicates an annular end plate fitted in the tubular casing 2 at the smaller diameter end thereof.

In use of the mould constructed as described above, grout or raw concrete is poured continuously through the larger-diameter end thereof while the mould is rotating about its own axis together with the annular drive wheels 3 and is formed under centrifugal into a tapered solid or hollow concrete body C along the inner peripheral wall surface of the tubular casing 2. The taper of the tubular casing 2 and the product pole should be selected according to the use of products and, for poles for electric power distribution use, is ordinarily set at 1 in 75.

For removal of the formed body of concrete C from the tubular form or casing 2, the entire mould is held in the illustrated angular position with the guide member 12 of the outer frame held at the bottom of the mould, and the tubular casing 2 is forced to the left, as viewed in FIGS. 1 and 1A, to slide along the guide member 12, which acts to hold the tubular casing 2 against angular displacement, as described above, through the medium of the stiffening member 22 slidably fitted in the longitudinal groove 120 formed in the guide member 12. With the leftward movement of the tubular casing 2 along the guide member 12, the stiffening members 23 and 24 of tubular casing 2, now lying in a horizontal axial plane, are moved apart from the respective adjacent guide members 13 and 14 of the outer frame by a distance equal to, for example, 1/75 of the axial distance over which the tubular casing 2 is moved, because of the tapered formation of the mould. Similarly, the stiffening members 21 arranged on the opposite sides of the gap 20 and now lying at the top of tubular casing 2 are moved apart from the adjacent guide member 11 by a distance corresponding to 2/75 of the distance of axial movement of the tubular casing 2, allowing the gap 20 to open in the casing wall under the resiliency of the casing itself. In this manner, the tubular casing 2 can be separated from the pole body formed therein with extreme ease and efficiency.

As will be readily appreciated from the foregoing description, the mould structure of the present invention, eliminating the need for any bolt operation as required with conventional tapered moulds, has an important advantage of facilitating mechanization of the mould operation including removal of the product.

Figure 5:
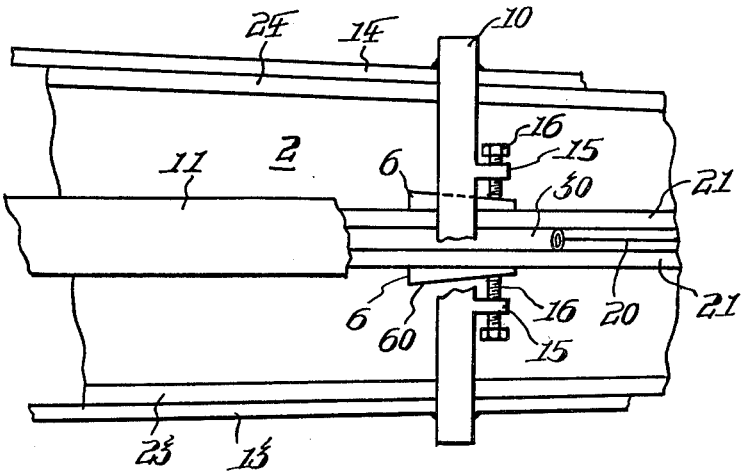
FIG. 5 is a fragmentary plan view of a portion of FIG. 1, taken along the line V—V therein, with one of the guide members partly broken away.
Figure 6:
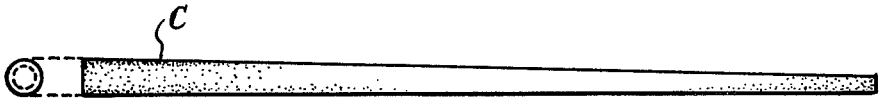
FIG. 6 represents an end and a side view illustrating, on a reduced scale, tapered concrete poles formed by the mould of the present invention.

FIG. 5 illustrates a modification of the embodiment described, which includes a pair of wedges 6—6 fixed as by welding to the outer radially extending sides of the respective stiffening members 21—21, which are arranged on the tubular casing 2 on the opposite sides of the gap 20. As illustrated, the outside surface 60 of each of the wedges 6 is inclined at an angle corresponding to the taper of tubular casing 2 with respect to the adjacent side of the associated stiffening member 21. Arranged on the adjacent one of annular connecting members 10 of the outer frame are a pair of aligned guide elements for abutting engagement with the respective wedges 6. In the modification illustrated, the guide elements each take the form of a threaded bolt 16 which is adjustably threaded through a lug 15 formed on the connecting member 10 into abutting engagement with the inclined surface 60 of the adjacent wedge 6. It will be readily understood that the threaded bolts 16, cooperating with the respective wedges 6, serve to further ensure that the gap 20 in the tubular casing 2 be closed and held closed under the restraining effect of guide members 11–14 as exerted upon the respective stiffening members 21–24 of tubular casing 2. Such arrangement is highly desirable as means for preventing any accidental gap opening in the process of centrifugal casting.

As will be readily appreciated from the foregoing description, the mould structure of the present invention, eliminating the need for any bolt-clamping and releasing operation as required with conventional tapered moulds, has an important advantage of facilitating mechanization of mould operation including removal of products.

Though one preferred embodiment and its modification have been shown and described, it will be apparent to those skilled in the art that various changes and alterations may be made as regards the details described without departing from the scope of the invention as defined in the appended claims.

I claim:

1. A mould structure for use in making tapered concrete poles, comprising: a tapered outer frame essentially consisting of a plurality of longitudinal guide members (11–14) radially arranged about a common axis and each inclined to the axis at an angle corresponding to the taper of concrete poles to be formed, the mould structure having a longitudinally extending mould axis, a plurality of annular connecting members (10) axially spaced from each other and each secured to said guide members in their respective angular positions spaced apart from each other, and at least one annular drive wheel (3) secured to said guide members in encircling relation thereto; and a frustoconical tubular casing (2) of resilient steel sheet material formed with the same taper as that of said outer frame so as to be inserted in said outer frame substantially coaxially therewith and having a gap (20) formed in the wall of said tubular casing along a longitudinal line on its periphery and extending the entire length thereof, said tubular casing (2) having a pair of longitudinally extending stiffening members (21—21) secured to the outer peripheral surface thereof on the opposite sides of said gap (20) and a number of additional longitudinally extending stiffening members (22–24) secured to said outer peripheral surface in spaced relation to each other and to said pair of stiffening members (21—21), all of said stiffening members (21–24) being placed in contact with the respective guide members (11–14) of said outer frame for sliding movement therealong so that said gap (20) is opened and closed as said tubular casing (2) is moved axially in opposite directions relative to said outer frame.

2. A mould structure as claimed in claim 1, in which one (22) of said stiffening members arranged on said tubular casing (2) is positioned diametrally opposite to said gap (20) formed in the wall thereof and the adjacent one (12) of said guide members of said outer frame is formed with a groove (120) extending longitudinally thereof to slidably receive said one of said stiffening members (22) thereby to prevent angular displacement of said tubular casing (2) relative to said outer frame about the mould axis.

3. A mould structure as claimed in claim 1, wherein said longitudinal guide members and said stiffening members extend the length of the tubular casing to facilitate control of said gap (20) by axial movement of said tubular casing relative to said outer frame.

4. A mould structure as claimed in claim 1, in which wedge means (6) are secured to surfaces remote from the gap of the stiffening members (21,21) which are on the opposite sides of the gap and in which, guide and control means operatively engage an annular connecting member (10) and extend circumferentially to engage said wedge means to insure retaining the tubular casing against any gap opening movement.

* * * * *